US007445197B2

(12) United States Patent
Ooyachi et al.

(10) Patent No.: US 7,445,197 B2
(45) Date of Patent: Nov. 4, 2008

(54) APPARATUS FOR PRODUCING CARBONATED WATER AND METHOD FOR PRODUCING CARBONATED WATER USING THE SAME

(75) Inventors: Ken Ooyachi, Aichi (JP); Hiroki Sakakibara, Tokyo (JP); Hiroshi Tasaka, Aichi (JP); Masaaki Satou, Aichi (JP); Masanori Itakura, Tokyo (JP); Katsuya Sanai, Tokyo (JP)

(73) Assignees: Mitsubishi Rayon Co., Ltd., Tokyo (JP); Mitsubishi Rayon Engineering Co., Ltd., Tokyo (JP)

( * ) Notice: Subject to any disclaimer, the term of this patent is extended or adjusted under 35 U.S.C. 154(b) by 183 days.

(21) Appl. No.: 10/520,516

(22) PCT Filed: Jul. 7, 2003

(86) PCT No.: PCT/JP03/08616

§ 371 (c)(1),
(2), (4) Date: Jan. 7, 2005

(87) PCT Pub. No.: WO2004/004876

PCT Pub. Date: Jan. 15, 2004

(65) Prior Publication Data

US 2005/0260301 A1 Nov. 24, 2005

(30) Foreign Application Priority Data

Jul. 8, 2002 (JP) ..... 2002-198926
Aug. 19, 2002 (JP) ..... 2002-238445

(51) Int. Cl.
*B01F 3/04* (2006.01)

(52) U.S. Cl. ..... 261/36.1; 261/79.2; 261/104; 261/DIG. 7

(58) Field of Classification Search ..... 261/36.1, 261/37, 38, 64.3, 72.1, 79.2, 94, 95, 96, 100, 261/101, 102, 104, 121.1, 122.1, DIG. 7; 366/337–339
See application file for complete search history.

(56) References Cited

U.S. PATENT DOCUMENTS

| | | | | |
|---|---|---|---|---|
| 3,643,688 | A * | 2/1972 | Meinert | 137/556 |
| 4,674,888 | A * | 6/1987 | Carlson | 366/337 |
| 5,288,311 | A * | 2/1994 | Furutani et al. | 96/110 |
| 5,356,533 | A * | 10/1994 | Nakagawa | 210/123 |
| 5,690,786 | A * | 11/1997 | Cirucci et al. | 162/6 |
| 6,158,721 | A * | 12/2000 | Katou et al. | 261/26 |
| 6,164,632 | A * | 12/2000 | Uchida et al. | 261/102 |
| 6,905,111 | B2 * | 6/2005 | Nagasaka et al. | 261/36.1 |
| 7,152,850 | B2 * | 12/2006 | Sakakibara et al. | 261/36.1 |

FOREIGN PATENT DOCUMENTS

| | | |
|---|---|---|
| AT | 394 808 B | 6/1992 |
| DE | 38 40 567 A1 | 6/1990 |
| DE | 42 32 000 A1 | 4/1993 |
| EP | 1 421 988 A1 | 5/2004 |

(Continued)

*Primary Examiner*—Scott Bushey
(74) *Attorney, Agent, or Firm*—Fitch, Even, Tabin & Flannery

(57) ABSTRACT

This invention concerns an apparatus and a method for producing carbonated water capable of obtaining high concentration carbonated water effectively. Carbon dioxide gas is passed through a first carbon dioxide gas dissolver (7) composed of a membrane module to be dissolved in water and the carbonated water passing through the first carbon dioxide gas dissolver (7) is passed through a static mixer (13), which is a second carbon dioxide gas dissolver. Consequently, a high concentration carbonated water can be obtained remarkably, effectively and easily with a simpler structure than conventionally.

15 Claims, 1 Drawing Sheet

FOREIGN PATENT DOCUMENTS

| | | | |
|---|---|---|---|
| JP | 02-279158 | A | 11/1990 |
| JP | 05-023150 | A | 2/1993 |
| JP | 05-238928 | A | 9/1993 |
| JP | 07-313855 | A | 12/1995 |
| JP | 07-328403 | A | 12/1995 |
| JP | 08-215270 | A | 8/1996 |
| JP | 2000-005586 | A | 1/2000 |
| JP | 2001-293343 | A | 10/2001 |
| JP | 2001-293344 | A | 10/2001 |
| JP | 2002-166148 | A | 6/2002 |
| WO | WO 00/25904 | A1 | 5/2000 |
| WO | WO 03/037492 | A1 | 5/2003 |

* cited by examiner

APPARATUS FOR PRODUCING CARBONATED WATER AND METHOD FOR PRODUCING CARBONATED WATER USING THE SAME

CROSS-REFERENCED APPLICATIONS

This application is the U.S. National Stage of PCT/JP2003/008616, filed Jul. 7, 2003, the complete disclosure of which is incorporated herein by reference, which was not published in the English language.

TECHNICAL FIELD

The present invention relates to an apparatus for producing carbonated water and a method for producing carbonated water using the same, and more particularly to an apparatus for producing carbonated water capable of obtaining the carbonated water effectively and a method for producing the carbonated water using the same.

BACKGROUND ART

Carbonated water has been used in a bathing place using hot spring since the carbonated water has an excellent effect of keeping warm. The effect of keeping warm of carbonated water is considered to be because basically the human body condition is improved by distal blood vessel expansion effect by its contained carbon dioxide gas. Additionally, the blood capillaries increase and expand due to invasion of carbon dioxide gas into the skin, so that blood circulation in the skin structure is improved. It has been said that carbonated water is effective for diagnoses for regressive disease and distal circulation trouble.

To obtain such carbonated water artificially, there are available a chemical method of reacting carbonate with acid, a method of using combustion gas from a boiler or an apparatus which injects carbon dioxide gas directly into a pipe having a diaphragm as described in, for example, Japanese Patent Laid-Open Publication No. 5-238928 and the like. Recently, a number of methods for producing carbonated water using a membrane have been proposed. Because using the membrane enables carbon dioxide to be supplied in a very fine condition, carbonated water can be produced effectively. For example, Japanese Patent Publication No. 2810694 has proposed a method which uses a hollow fiber membrane module accommodating plural hollow fiber membranes, both ends of which are open, and as this hollow fiber membrane, porous hollow fiber membrane is employed. Further, methods of using non-porous hollow fiber membrane as the hollow fiber membrane have been proposed through, for example, Japanese Patent Publication No. 3048499, Japanese Patent Publication No. 3048501, and Japanese Patent Laid-Open Publication No. 2001-293344 and the like.

As the method for producing carbonated water using the membrane there are available what is called single-pass type of producing carbonated water by passing raw water through a carbon dioxide gas dissolver having a membrane module by one time and what is called circulation type of circulating hot water in a bath with a circulation pump through a carbon dioxide gas dissolver.

Although the single-pass type is capable of producing carbonated water in a short time because carbon dioxide gas is dissolved in water all at once, it has such a disadvantage that its dissolution efficiency is lower than the circulation type so that a high concentration is difficult to obtain. Thus, it has been demanded to improve the dissolution efficiency further.

On the other hand, although the circulation type ensures a higher diffusion efficiency of carbon dioxide gas than the single-pass type so that a high concentration of it is easier to obtain because it is dissolved in water slowly, it takes long to dissolve until a predetermined concentration is reached and thus, it has been also demanded to improve the dissolution efficiency further.

Accordingly, an object of the present invention is to provide an apparatus for producing carbonated water and a method for producing carbonated water using the same apparatus, capable of obtaining carbonated water having a high dissolution efficiency of carbon dioxide gas, that is, a high concentration of it in a short time easily.

DISCLOSURE OF THE INVENTION

Such an object is achieved by an apparatus for producing carbonated water comprising: carbon dioxide gas supplying means; water supplying means and/or water circulating means; a first carbon dioxide gas dissolver connected to the carbon dioxide gas supplying means and the water supplying means and/or the water circulating means; and a second carbon dioxide gas dissolver connected to a carbonated water discharging side of the carbon dioxide gas dissolver.

If the first carbon dioxide gas dissolver has a membrane module, the highest dissolution efficiency can be attained. In this case, the membrane of the module is preferred to be a hollow fiber membrane, particularly the hollow fiber membrane is preferred to be a three-layer composite hollow fiber membrane in which both faces of thin non-porous gas permeation layer are sandwiched by porous layers.

As the second carbon dioxide gas dissolver, a static mixer can be used. When high concentration carbonated water whose concentration of free carbon is 800 mg/L or more, particularly 1000 mg/L or more is produced, the quantity of non-dissolved carbon dioxide gas increases as the exit of the first carbon dioxide gas dissolver is approached so that the dissolution efficiency tends to drop. The second carbon dioxide gas dissolver dissolves such non-dissolved carbon dioxide gas to suppress reduction in dissolution efficiency. If the static mixer is of stator type and/or Kenics type, carbon dioxide gas can be dissolved in low-viscosity fluid like water, which the present invention employs, at a high dissolution efficiency in a state in which pressure loss is small and at the same time, it can be supplied at a low price. The second carbon dioxide gas dissolver of the present invention dissolves non-dissolved carbon dioxide gas after a discharge port of the first carbon dioxide gas dissolver and basically, no carbon dioxide gas supplying means is connected to the second carbon dioxide gas dissolver.

If a flow rate control valve for maintaining the flow rate of carbon dioxide gas to a constant level is provided between the carbon dioxide gas supply means and the first carbon dioxide gas dissolver and a flow rate control valve for maintaining the flow rate of water to a constant level is provided between the water supplying means or/and the water circulating means and the first carbon dioxide gas dissolver, the concentration of free carbon in carbonated water can be controlled at a high accuracy.

If the first carbon dioxide gas dissolver is connected to the water supplying means, it is preferable to provide with a pressure increasing pump. It is possible to prevent a necessary flow rate from not being satisfied due to pressure loss in the carbon dioxide gas dissolver when the water pressure in the supplying means is low.

Further, if a start/stop flow switch for starting/stopping at least the operation of the pressure increasing pump is provided in a line of the carbonated water producing apparatus, through which water or carbonated water passes, idling of the pump can be prevented, preferably.

Although by passing through the first and second carbon dioxide gas dissolvers, carbon dioxide gas can be dissolved in water very effectively, it is preferable to provide a liquid-vapor separator after the second carbon dioxide gas dissolver because partially non-dissolved carbon dioxide gas exists. Further, estimating a case where the function of the liquid-vapor separator is lost due to any trouble, it is preferable to provide a pipe after the liquid-vapor separator with a bubble sensor. The bubble sensor is preferred to be of ultrasonic type. Further, estimating a case where carbon dioxide gas leaks due to any trouble in the apparatus, it is preferable to provide the apparatus with a carbon dioxide gas concentration sensor or/and an oxygen concentration sensor.

Further, the above-described object is achieved by a method for producing carbonated water comprising steps of: supplying water and carbon dioxide gas to a first carbon dioxide gas dissolver; and supplying obtained carbonated water to a second carbon dioxide gas dissolver, which is a second basic configuration of the present invention. An operation and effect peculiar to the present invention can be exerted by adopting the above-described various preferable embodiments of the apparatus.

Here, by adjusting the temperature of the carbonated water in a range of 30 to 45° C. and the concentration of free carbon in the carbonated water in a range of 800 to 1500 mg/L, the operation of keeping warm of carbonated water can be exerted effectively.

When carbon dioxide gas is dissolved in water, it is converted to existence formations of $CO^2$, $HCO_3^-$, $CO_3^{2-}$ and each existence ratio changes depending on pH of water. The concentration of free carbon in carbonated water of the present invention refers to a concentration when all these existence formations are gathered.

BEST MODE FOR CARRYING OUT THE INVENTION

Figure 1:
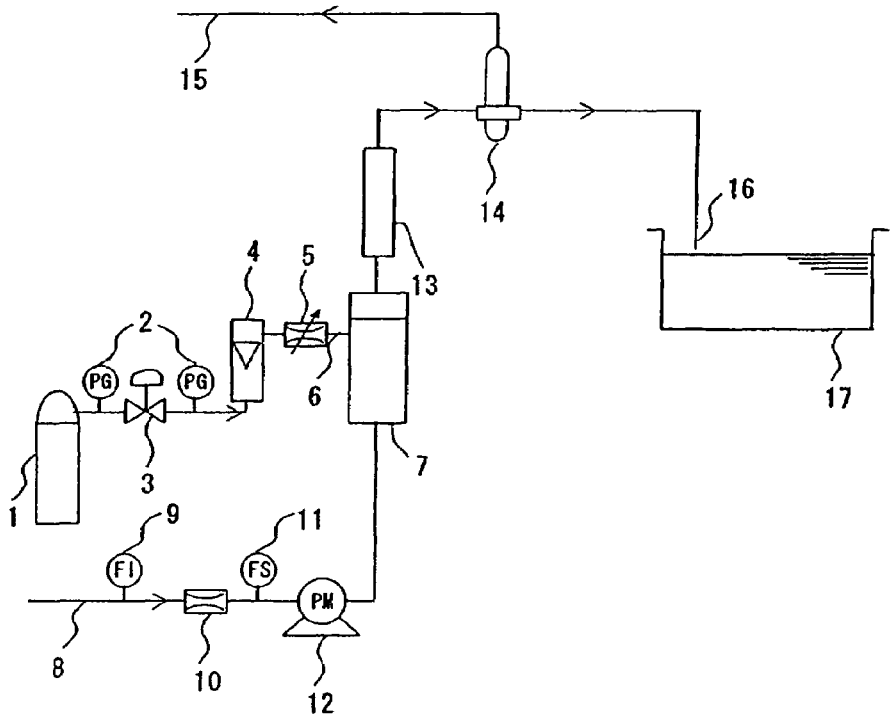
FIG. 1 is a diagram schematically showing an entire configuration of a single-pass type apparatus preferably applied to the present invention.

Hereinafter, typical embodiments of the present invention will be described specifically with reference to the drawings. FIG. 1 is an example of a diagram schematically showing an entire configuration of a preferred single-pass type of the present invention. Reference numeral 1 denotes a carbon dioxide gas cylinder, reference numeral 2 denotes a pressure gauge, reference numeral 3 denotes a pressure control valve, reference numeral 4 denotes a carbon dioxide gas flow gauge, reference numeral 5 denotes a carbon dioxide gas flow rate control valve, reference numeral 6 denotes a carbon dioxide gas intake, reference numeral 7 denotes a membrane module which is a component of a first carbon dioxide gas dissolver, reference numeral 8 denotes a hot water passage, reference numeral 9 denotes a water flow gauge, reference numeral 10 denotes a water flow rate control valve, reference numeral 11 denotes a flow switch, reference numeral 12 denotes a pressure increasing pump, reference numeral 13 denotes a static mixer, which is a second carbon dioxide gas dissolver, reference numeral 14 denotes a liquid-vapor separator, reference numeral 15 denotes a gas exhaust port, reference numeral 16 denotes a carbonated water discharge port, and reference numeral 17 denotes a bath.

In case of the single-pass type carbonated water producing apparatus indicated in the same figure, hot water is supplied at a specified flow rate from a water heater (not shown) through the hot water passage 8 and the water flow rate control valve 10 and then, pressurized up to a predetermined pressure by the pressure increasing pump 12 and supplied to the membrane module 7. On the other hand, carbon dioxide gas from the carbon dioxide cylinder 1 is depressurized by the pressure control valve 3 and introduced into the membrane module 7 from the carbon dioxide gas intake of the membrane module 7 with its flow rate being controlled by the carbon dioxide gas flow rate control valve 5.

Hot water introduced to this membrane module 7 passes through the hollow portions in plural hollow fiber membranes (not shown) disposed in the same module 7 or passes through outside thereof. When hot water passes, carbon dioxide gas introduced to an opposite side to the hot water through the hollow fiber membranes permeates the hollow fiber membranes and dissolves in water so as to generate carbonated water. Preferably, this hollow fiber membrane is composed of three-layer composite hollow fiber membranes in which both faces of a thin membrane non-porous layer having an excellent gas permeability are sandwiched with porous layers and for example, three-layer composite hollow fiber membrane (MHF) made by Mitsubishi Rayon Company can be mentioned.

The non-porous gas permeation membrane refers to a membrane which gas permeates through a dissolving and diffusion mechanism and any membrane is accepted as long as it does not contain any pore which gas can pass through in the form of gas like Knudsen flow. Using the non-porous gas permeation membrane enables gas to be supplied and dissolved under any pressure without being discharged in the form of bubbles, so that gas can be dissolved effectively and easily under an excellent controllability to any concentration. Additionally, no water or aqueous solution flows back to the gas supply side through that membrane.

The carbonated water generated by the membrane module 7 is introduced into the static mixer 13, which is a second carbon dioxide gas dissolver constituting part of the feature portion of the present invention like the membrane module 7. Using the static mixer 13 enables carbon dioxide gas to be dissolved in a low viscosity fluid like water at a high dissolution efficiency with little pressure loss and at the same time, carbonated water can be supplied at a low cost. The second carbon dioxide gas dissolver of the present invention dissolves non-dissolved carbon dioxide gas left after the discharge port of the first carbon dioxide gas dissolver effectively. Thus, basically, no carbon dioxide gas needs to be supplied to this second carbon dioxide gas dissolver. Non dissolved carbon dioxide gas is discharged from carbonated water passing through the static mixer 13 by the liquid-vapor separator 14 and the carbonated water is discharged to the bath 17.

Figure 2:
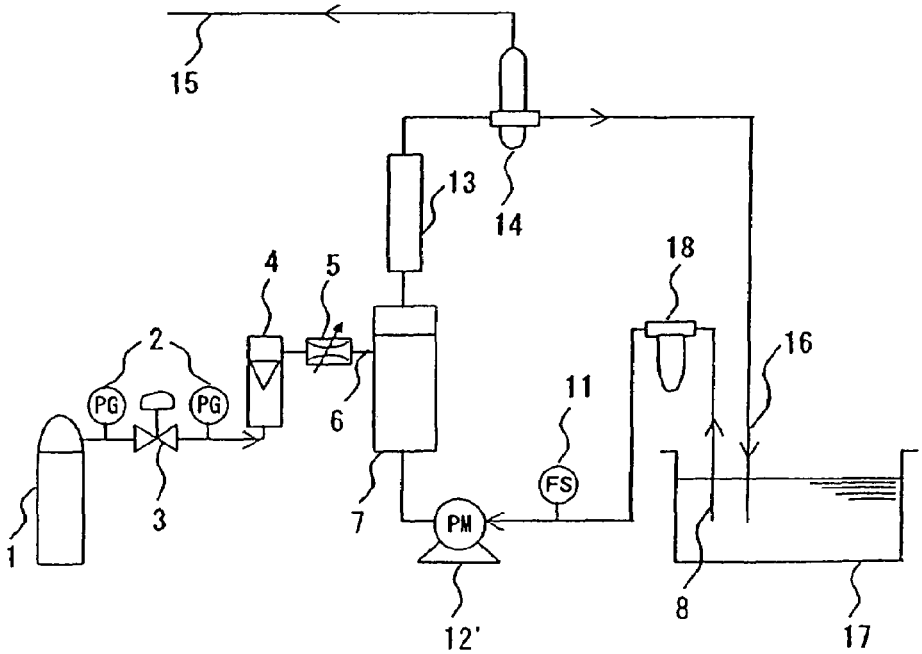
FIG. 2 is a diagram schematically showing an entire configuration of a circulation type apparatus preferably applied to the present invention.

FIG. 2 is a diagram schematically showing an entire configuration of a preferred circulation type apparatus of the present invention. Reference numeral 1 denotes a carbon dioxide gas cylinder, reference numeral 2 denotes a pressure gauge, reference numeral 3 denotes a pressure control valve, reference numeral 4 denotes a carbon dioxide gas flow gauge, reference numeral 5 denotes a carbon dioxide gas flow rate control valve, reference numeral 6 denotes a carbon dioxide gas intake, reference numeral 7 denotes a membrane module, reference numeral 8 denotes a hot water passage, reference numeral 11 denotes a flow switch, reference numeral 12' denotes a circulation type pump, reference numeral 13 denotes a static mixer, reference numeral 14 denotes a liquid-vapor separator, reference numeral 15 denotes a gas exhaust port, reference numeral 16 denotes carbonated water discharge port, reference numeral 17 denotes a bath, and reference numeral 18 denotes a pre-filter. Like reference numerals are attached to substantially the same components as FIG. 1 and in FIG. 2, the components marked with a different reference numeral from FIG. 1 are the circulation pump 12' which substitutes the pressure increasing pump 12 and a newly installed pre-filter 18.

In this circulation type carbonated water producing apparatus, carbonated water is supplied from the bath 17 to the membrane module 7 through the hot water intake 8 and the pre-filter 18 by the circulation pump 12'. On the other hand, carbon dioxide gas from the carbon dioxide gas cylinder 1 is depressurized to a specified pressure by the pressure control valve 3 while controlled its flow rate by the carbon dioxide gas flow rate control valve 5 and introduced to the membrane module 7 from the carbon dioxide gas intake of the membrane module 7 and dissolved in hot water. The hot water is returned to the bath 17. By repeating this, the concentration of free carbon in carbonated water rises gradually. Further, carbon dioxide gas can be circulated in order to replenish carbonated water whose concentration of free carbon drops in the bath with carbon dioxide gas newly.

Although carbonated water can be produced even if the carbon dioxide gas flow rate control valve 5 is excluded, it is preferable to provide with the carbon dioxide gas flow rate control valve 5 in order to control the concentration of free carbon in carbonated water at a high precision. As the carbon dioxide gas flow rate control valve 5, various kinds of needle valves, and electronic piezo or solenoid actuator can be mentioned. The needle valve is preferred because it is cheap although this use is not limited. Further, it is permissible to use an orifice having a diaphragm, The carbon dioxide gas flow rate control valve 5 is capable of always controlling the flow rate to a constant level, and further, providing with the carbon dioxide gas flow gauge 4 enables the flow rate to be visualized so that the content can be determined quickly when any trouble occurs. As the carbon dioxide gas flow gauge 4, a float type, electronic type and the like can be mentioned. Although the carbon dioxide gas flow gauge 4 is provided between the carbon dioxide gas cylinder 1 and the membrane module 7, because pressure loss in the membrane module 7 is always not constant, in case of the float type, the carbon dioxide gas flow gauge is preferred to be provided between the carbon dioxide gas cylinder 1 and the carbon dioxide gas flow rate control valve 5 because a differential pressure between the intake and outlet of the gas flow gauge 4 is constant.

In case of the single-pass type shown in FIG. 1, hot water is supplied from the water heater and in case of the circulation type shown in FIG. 2, hot water stored in the bath is circulated. Although carbonated water can be produced without any water flow rate control valve 10, it is preferable to provide with the water flow rate control valve 10 in order to control the concentration of free carbon in carbonated water at a high precision. If it is used together with the aforementioned carbon dioxide gas flow rate control valve 5, the concentration of free carbon in carbonated water can be controlled at a high precision. Although the type of the water flow rate control valve 10 is not restricted to any particular type, a control valve for fan coil is preferred because it is not affected by a pressure before and after the valve. Further, it is preferred to provide with the water flow gauge 9 for the same reason as the carbon dioxide gas flow rate control valve 5.

In case of the single-pass type shown in FIG. 1, providing with the pressure increasing pump 12 is preferable because it can prevent the flow rate from dropping out of its satisfactory level due to influences of pressure loss in the carbon dioxide gas dissolver when the water pressure in a supply means is low. It is preferable to provide with the flow switch 11 in a line which water or carbonated water passes through in order to prevent the pumps 12, 12' from idling.

The first carbon dioxide gas dissolver can use an air stone, sintered metal or membrane module and by using these, carbon dioxide gas can be dissolved effectively into water. Of these, it is preferable to use the membrane module 7 in order to dissolve carbon dioxide gas effectively into water. Although as the first carbon dioxide gas dissolver, it can be considered to use the static mixer, the quantity of the elements in the static mixer needs to be large so as to dissolve carbon dioxide gas into water effectively and consequently, pressure loss increases as compared with the membrane module. Thus, it is preferred to use the membrane module as the first carbon dioxide gas dissolver.

Although as the membrane type, flat membrane, tubular membrane, hollow fiber membrane, spiral membrane and the like can be mentioned, the hollow fiber membrane is the most preferable considering the compactness and ease of handling of the apparatus.

As the membrane, various kinds of membranes are available as long as excellent gas permeability is ensured and both porous hollow fiber membrane and non-porous hollow fiber membrane are acceptable. If the porous hollow fiber membrane is used, the diameter of the pore opening in the surface is preferred to be 0.01 to 10 μm.

The most preferable hollow fiber membrane is three-layer composite hollow fiber membrane in which both faces of thin non-porous gas permeation layer are sandwiched by porous layers as described previously. The non-porous gas permeation layer (membrane) is a membrane which gas permeates through dissolving/diffusion mechanism and any membrane is acceptable as long as it substantially does not contain a pore which gas can permeate in the form of gaseous state like Knudsen flow. Using the non-porous membrane enables carbon dioxide gas to be supplied and dissolved without being discharged into carbonated water in the form of bubbles, so that gas can be dissolved effectively and easily under an excellent controllability to any concentration. Further, backlash, which sometimes occurs in the porous membrane, that is, flow back of hot water to a gas supply side through fine pores never occurs. In case of the three-layer composite hollow fiber membrane, because its non-porous layer is formed in the form of a very thin membrane having excellent gas permeability and this membrane is protected by the porous material, preferably, it is unlikely to be damaged.

The thickness of the hollow fiber membrane is preferred to be 10 μm to 150 μm. If the thickness is less than 10 μm, the membrane strength is likely insufficient and if it exceeds 150 μm, the permeation velocity of carbon dioxide gas drops so that the dissolution efficiency likely drops. In case of the three-layer composite hollow fiber membrane, the thickness of the non-porous membrane is preferred to be 0.3 to 2 μm. If the thickness is less than 0.3, the membrane is likely to deteriorate and if the membrane deteriorates, leakage is likely to occur. If it exceeds 2 μm, the permeation velocity of carbon dioxide gas drops, so that dissolution efficiency likely drops.

As a preferred membrane material of the hollow fiber membrane, silicone base, polyolefin base, polyester base, polyamide base, polyimide base, polysulfone base, cellulose base, polyurethane base and the like can be mentioned. As a preferred material of the non-porous membrane in the three-layer composite hollow fiber membrane, polyurethane, polyethylene, polypropylene, poly 4-methylpentene-1, polydimethyl siloxane, polyethyl cellulose, polyphenylene oxide and the like can be mentioned and particularly, polyurethane is preferred because it has an excellent membrane formation characteristic and has not much eluted substance.

The inside diameter of the hollow fiber membrane is preferred to be 50 to 1000 μm. If it is less than 50 μm, the flow path resistance of carbon dioxide gas or hot water flowing through the hollow fiber membrane increases, so that it is difficult to supply carbon dioxide gas or hot water. Further if it exceeds 1000 μm, the size of the dissolver increases, so that the compactness thereof is lost.

According to the present invention, it is important to supply water and carbon dioxide gas to the first carbon dioxide dissolver and then supply the obtained carbonated water to the second carbon dioxide gas dissolver.

Although according to the present invention, carbon dioxide gas is dissolved in water with the first carbon dioxide gas dissolver, the quantity of non-dissolved carbon dioxide gas increases as the outlet of the first carbon dioxide gas dissolver is approached, so that the dissolution efficiency likely drops. The second carbon dioxide gas dissolver dissolves such non-dissolved carbon dioxide gas so as to suppress reduction of the dissolution efficiency. When high concentration carbonated water, whose concentration of free carbon is 800 mg/L or more, particularly 1000 mg/L or more, is produced, increase in the quantity of non-dissolved carbon dioxide gas is remarkable and the present invention is particularly effective when such a high concentration carbonated water is produced. Depending on case, it is permissible to connect a third or more carbon dioxide gas dissolvers.

The membrane module 7 for use in the first carbon dioxide gas dissolver enables its dissolution efficiency to be intensified by increasing the membrane area particularly in case of the single-pass type. According to the present invention, even if a membrane module having a small membrane area is employed for the first carbon dioxide gas dissolver, the non-dissolved carbon dioxide gas can be dissolved with the first carbon dioxide gas dissolver by passing carbonated water produced in the membrane module through the second carbon dioxide gas dissolver, so that the dissolution efficiency can be improved easily.

In case of the circulation type, as the flow rate ratio between the flow rate in the circulation pump 12' and carbon dioxide gas is increased, the dissolution efficiency rises. However, because the quantity of the flow rate of the circulation pump increases or that of carbon dioxide gas decreases as the ratio is increased, there occurs such a disadvantage that power consumption increases or production time is prolonged. However, by using the second carbon dioxide gas dissolver, the dissolution efficiency is improved as compared with a case where no second carbon dioxide gas dissolver is provided even if the flow rate ratio between the flow rate in the circulation pump and carbon dioxide gas is equal and thus, if it is desired to obtain the same dissolution efficiency, the flow rate ratio between the flow rate in the circulation pump and carbon dioxide gas can be decreased, so that power consumption can be reduced and production time can be reduced.

Preferably, the temperature of carbonated water is in a range of 30° C. to 45° C. and this range ensures the highest effect of keeping warm and provides a comfortable bathing condition.

The circulation type shown in FIG. 2 requires the circulation pump 12'. The pump is preferred to be a volume type proportioning pump having a self absorption performance. By using this, stabilized circulation and constant circulation water quantity on a steady basis can be achieved. Although if the concentration of carbonated water heightens, bubbles are likely to occur so that bubble rich state is attained, in this case, water can be fed stably by using a pump having a self absorption performance which can be started without priming at the initial operation.

As the second carbon dioxide gas dissolver, the static mixer 13 is preferred. The static mixer 13 separates fluid mechanically so as to diffuse carbon dioxide gas. The details of the static mixer is described in, for example, Chapter 1 of Static Mixing Device, Basics and Applications, supervised by Shingo Ogiwara, issued by Nikkan Kogyo Shinbun-sha (first print of first edition, Sep. 30, 1981).

As the static mixer 13, it is preferable to use particularly, stator type and/or Kenics type. The stator type is the static mixer disclosed in U.S. Pat. No. 4,093,188 and the like and as for its structure, each stage is constituted of three semi-elliptical baffles and two baffles intersect along a center axis while another baffle is combined on an opposite side. On the other hand, the Kenics type is so constructed that a spiral element twisted to the right and a spiral element twisted to the left are disposed alternately in a tube and this is called spiral type depending on case.

These are suitable for the static mixer which the present invention uses and capable of dissolving carbon dioxide gas in water at a high dissolution efficiency under a state having s small pressure loss, thereby making it possible to supply carbonated water at low price.

When water is fed to the static mixer 13 at an equal flow rate, as the number of elements exists in an aisle increases, mixing is accelerated, so that the concentration of free carbon in generated carbonated water tends to rise.

However, if the quantity of the elements is more than 100, the concentration of free carbon in the generated carbonated water reaches its limit and pressure loss generated when water is fed becomes extremely large, so that feeding of water is disabled.

On the other hand, because the effect of improvement in dissolution efficiency by the static mixer vanishes if the quantity of the elements is smaller than 5, the lower limit of the elements of the static mixer is preferred to be 5 or more, more preferred to be 10 or more. Further, the upper limit of the elements is preferred to be 100 or less, more preferred to be 50 or less.

As for the static mixer 13, there is no problem if a single piece is used, however, plural pieces may be connected in series for use. The number of elements in case of connection in series refers to the number of elements existing in a single flow path and for example if five pieces of the static mixers each comprising seven elements are connected in series, the number of elements existing in a single flow path totals to 35.

The plural pieces of the static mixers 13 may be connected in parallel. Because connecting them in parallel enables to maintain a pressure loss at a low level and the quantity of carbonated water which can be generated at a time to be increased, it is preferable.

In case of connecting in parallel, even if, for example, five pieces of the static mixers each having 20 elements are connected in parallel, the number of elements existing in a single flow path is 20.

Because if the element diameter of the static mixer 13 is too small, the pressure loss increases so that water cannot be fed in a large quantity, the lower limit of the inside diameter is preferred to be 5 mm or more, more preferred to be 10 mm or more.

If the element diameter of the static mixer 13 is large, even if the flow rate of supplied water is increased, the pressure loss when water is supplied tends to drop.

However, because if the flow rate of supplied water is too large, the carbonated water producing apparatus becomes huge, the upper limit of the inside diameter is preferred to be 100 mm or less, more preferred to be 50 mm or less.

Although by passing through the first and second carbon dioxide gas dissolvers, carbon dioxide gas can be dissolved in water very effectively, however high the efficiency is, partially non-dissolved carbon dioxide gas exists. If a large amount of carbonated water is produced, it is preferable to provide the liquid-vapor separator 14 after the second carbon dioxide gas dissolver in order to eliminate a possibility that it may damage the human body. In the meantime, the liquid-vapor separator 14 communicates with the gas exhaust port 15.

As the liquid-vapor separator 14, it is permissible to use for example, a cheese pipe connected to an air vent valve.

Although by providing with the liquid-vapor separator 14, flow-out of non-dissolved carbon dioxide gas to the bath 17 is eliminated, it is preferable to provide a conduit pipe in the downstream of the liquid-vapor separator 14 with the bubble sensor presuming a case where the function of the liquid-vapor separator 14 is lost by any trouble such as clogging of the gas exhaust port. Provision of the bubble sensor enables the apparatus to be stopped by sensing a bubble mixed in the conduit pipe. The bubble sensor is preferred to be of ultrasonic type and by using an ultrasonic wave transmitter and ultrasonic wave receiver, which are disposed across the conduit pipe, bubbles can be sensed based on the damping factor of ultrasonic wave transmitted through the conduit pipe.

Further it is preferable to provide the apparatus with a carbon dioxide gas concentration sensor and/or an oxygen concentration sensor considering a possibility that carbon dioxide gas may leak. As the carbon dioxide gas concentration sensor, infrared ray type, solid electrolytic type and the like can be mentioned and as the oxygen concentration sensor, magnetic wind type, zirconia type, galvanic cell and the like can be mentioned.

Next, the present invention will be described specifically about the examples. The dissolution efficiencies shown in tables were obtained from a following equation.

Dissolution efficiency (%)=quantity of free carbon in carbonated water/quantity of consumed carbon dioxide×100

EXAMPLE 1

Carbonated water was produced with a carbonated water producing apparatus of single-pass type shown in FIG. 1. The first carbon dioxide gas dissolver employed a hollow fiber module made of Mitsubishi Rayon (Company) made three-layer composite hollow fiber membrane having an membrane area of 0.6 $m^2$ and carbon dioxide gas was supplied to the carbon dioxide gas dissolver at 4 L/min (calculated under 20° C.) while hot water of 40° C. was supplied at 5 L/min. A TAH industry (company) made stator type static mixer (type 050-032F, element diameter: 10.97 mm, number of elements: 14) was connected to the rear portion of the first carbon dioxide gas dissolver as the second carbon dioxide gas dissolver. Table 1 shows its results.

EXAMPLE 2

The same operation as Example 1 was done except that carbon dioxide gas was supplied to the gas dissolver at 3 L/min (calculated under 20° C.). Table 1 shows its results

EXAMPLE 3

The same operation as Example 1 was done except that a Noritake company limited (company) made Kenics type static mixer (DSP type, element diameter: 10 mm, number of elements: 12) was used as the static mixer. Table 1 shows its results.

COMPARATIVE EXAMPLE 1

The same operation as Example 1 was done except that no static mixer was connected. Table 1 shows its results. The dissolution efficiency dropped as compared with Example 1.

TABLE 1

| | First carbon dioxide gas dissolver | Second carbon dioxide gas dissolver | Concentration of free carbon (mg/L) | Dissolution efficiency (%) |
|---|---|---|---|---|
| Example 1 | Membrane module | Stator type static mixer | 1090 | 74 |
| Example 2 | Membrane module | Stator type static mixer | 970 | 88 |
| Example 3 | Membrane module | Kenics type static mixer | 1090 | 74 |
| Comparative example 1 | Membrane module | None | 910 | 62 |

EXAMPLE 4

Carbonated water was produced with a circulation type apparatus shown in FIG. 2. A hollow fiber module made of Mitsubishi Rayon (company) three-layer composite hollow fiber membrane having a membrane area of 0.6 $m^2$ was used as the first carbon dioxide gas dissolver and carbon dioxide gas was supplied to the carbon dioxide gas dissolver at 2 L/min (calculated at 20° C.). A TAH industries (company) made stator type, static mixer (type 050-032F, element diameter: 10.97 mm, number of elements: 14) was connected to the rear portion of the first carbon dioxide gas dissolver as the second carbon dioxide gas dissolver. Hot water of 40° C. was poured into the bath by 10L and hot water was returned to the bath at 5L every minute with a circulation pump. Table 2 shows a result after circulation for five minutes.

EXAMPLE 5

The same operation as Example 4 was done except that Noritake company limited (company) made Kenics type, static mixer (DSP type, element diameter: 10 mm, number of elements: 12) was used as the static mixer. Table 2 shows its result.

COMPARATIVE EXAMPLE 2

The same operation as Example 4 was done except that no static mixer was connected. Table 2 shows a result after circulation for five minutes. The concentration of free carbon and dissolution efficiency dropped as compared with Example 4.

COMPARATIVE EXAMPLE 3

The same operation was done except that no static mixer was connected and carbon dioxide gas was supplied to the carbon dioxide gas dissolver at 1 L/min (calculated under 20° C.). Table 2 shows a result after circulation for 10 minutes. Although the concentration of free carbon and dissolution efficiency are the same as Example 4, double production time is needed.

TABLE 2

| | First carbon dioxide gas dissolver | Second carbon dioxide gas dissolver | Production time (min) | Concentration of free carbon (mg/L) | Dissolution efficiency (%) |
|---|---|---|---|---|---|
| Example 4 | Membrane module | Stator type static mixer | 5 | 1310 | 65 |
| Example 5 | Membrane module | Kenics type static mixer | 5 | 1310 | 65 |
| Comparative example 2 | Membrane module | None | 5 | 1120 | 56 |
| Comparative example 3 | Membrane module | None | 10 | 1310 | 65 |

According to the method for producing carbonated water of the present invention, as evident from the above description, by dissolving carbon dioxide in water with a carbon dioxide gas dissolver employing the membrane module as its component as a first carbon dioxide gas dissolver, and feeding carbonated water passing through the first carbon dioxide gas dissolver through a static mixer as a second carbon dioxide gas dissolver, it is possible to obtain high concentration carbonated water remarkably, effectively and easily with a simpler structure than conventionally.

The invention claimed is:

1. A method for producing carbonated water comprising steps of:

supplying water and carbon dioxide gas to a first carbon dioxide gas dissolver, including a first membrane module; and supplying obtained carbonated water in the first carbon dioxide gas dissolver to a second carbon dioxide gas dissolver, including a static mixer, the second carbon dioxide gas dissolver being connected in line with said first carbon dioxide gas dissolver.

2. The method for producing carbonated water according to claim 1, wherein water is passed through the first carbon dioxide gas dissolver by single-pass.

3. The method for producing carbonated water according to claim 1, wherein water is circulated through the first carbon dioxide gas dissolver.

4. The method for producing carbonated water according to claim 1, wherein carbon dioxide gas is supplied to only the first carbon dioxide gas dissolver.

5. The method for producing carbonated water according to claim 1, wherein the membrane module contains a hollow fiber membrane.

6. The method for producing carbonated water according to claim 5, wherein the hollow fiber membrane is a three-layer composite hollow fiber membrane in which both faces of a thin non-porous gas permeation layer are sandwiched by porous layers.

7. The method for producing carbonated water according to claim 1, wherein the static mixer is a stator type and/or a Kenics type.

8. The method for producing carbonated water according to claim 1, wherein a number of elements in the static mixer is 5 to 100.

9. The method for producing carbonated water according to claim 1, wherein an element diameter of the static mixer is 5 to 100 mm.

10. The method for producing carbonated water according to claim 1, wherein carbon dioxide gas is supplied to the first carbon dioxide gas dissolver at a constant flow rate.

11. The method for producing carbonated water according to claim 1, wherein water is supplied to the first carbon dioxide gas dissolver at a constant flow rate.

12. The method for producing carbonated water according to claim 1, wherein a pressure increasing pump is disposed in an upstream of the first carbon dioxide gas dissolver and water pressurized by the pressure increasing pump is supplied to the first carbon dioxide gas dissolver.

13. The method for producing carbonated water according to claim 12, wherein a flow switch is disposed in a line, through which water or carbonated water passes, and the pressure increasing pump is driven only when water or carbonated water exists in the line.

14. The method for producing carbonated water according to claim 1, wherein said method includes setting the temperature of generated carbonated water in a range of 30 to 45° C.

15. The method for producing carbonated water according to claim 1, wherein said method includes setting the concentration of free carbon dioxide in the generated carbonated water in a range of 800 to 1500 mg/L.

* * * * *